United States Patent [19]

Miller et al.

[11] Patent Number: 4,956,646

[45] Date of Patent: Sep. 11, 1990

[54] DEPLOYMENT APPARATUS AND METHOD FOR RADIOSONDES

[75] Inventors: Edward J. Miller, Richboro, Pa.; John M. Beukers, Stony Brook, N.Y.; Maurice Friedman, Roslyn, Pa.

[73] Assignee: VIZ Manufacturing Company, Philadelphia, Pa.

[21] Appl. No.: 258,655

[22] Filed: Oct. 17, 1988

[51] Int. Cl.[5] ..... H01Q 1/30

[52] U.S. Cl. ..... 343/706; 343/877; 343/897

[58] Field of Search ..... 343/705, 706, 907, 877, 343/848, 849, 720, 893, 897; 455/97, 129, 40

[56] References Cited

U.S. PATENT DOCUMENTS

| | | | |
|---|---|---|---|
| 1,307,155 | 6/1919 | Schramm | 224/TD |
| 1,650,461 | 11/1927 | Nilson | 343/706 |
| 2,312,262 | 2/1943 | Murdoch et al. | 242/99 |
| 2,950,876 | 8/1960 | McLoughlin | 242/128 |
| 3,093,808 | 6/1963 | Tatnall et al. | 343/707 |
| 3,273,153 | 9/1966 | Icenbice, Jr. | 325/113 |
| 3,353,100 | 11/1967 | Collins et al. | 340/2 |
| 4,476,576 | 10/1984 | Wheeler et al. | 343/706 |

*Primary Examiner*—Rolf Hille
*Assistant Examiner*—Peter Toby Brown
*Attorney, Agent, or Firm*—Howson and Howson

[57] ABSTRACT

A flexible cord and antenna is paid out at a controlled rate from a radiosonde as it is lifted into the upper atmosphere by a balloon. The cord is knit into a tubular body and folded into a compartment in the radiosonde. The extended end is wrapped around the rotor of a centrifugal brake which limits the pay out rate. The knit tubular body unravels as the cord and antenna are paid out.

23 Claims, 3 Drawing Sheets

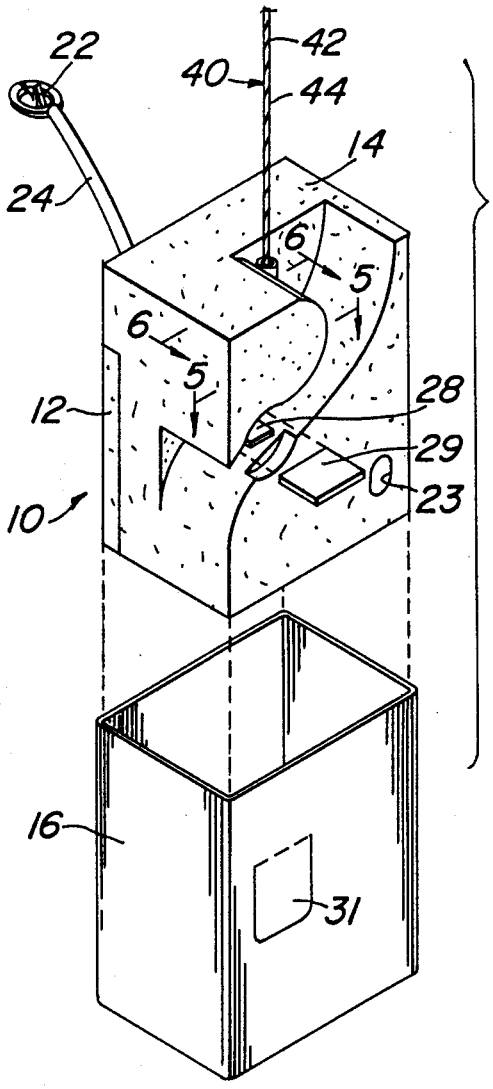
FIG. 1
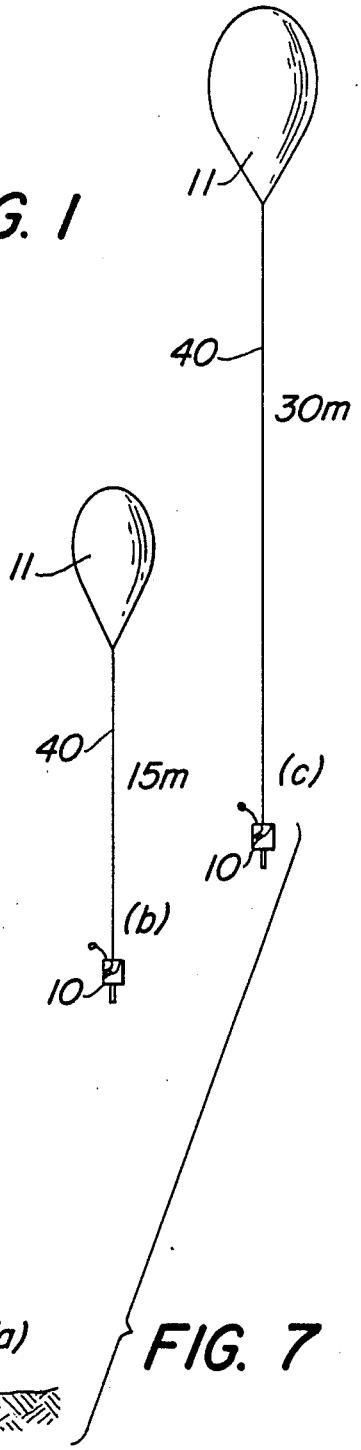
FIG. 7
FIG. 4
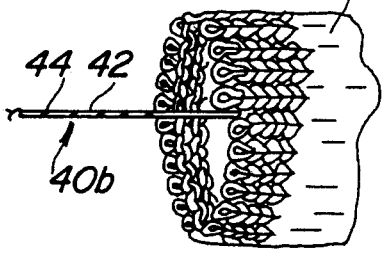

FIG. 5
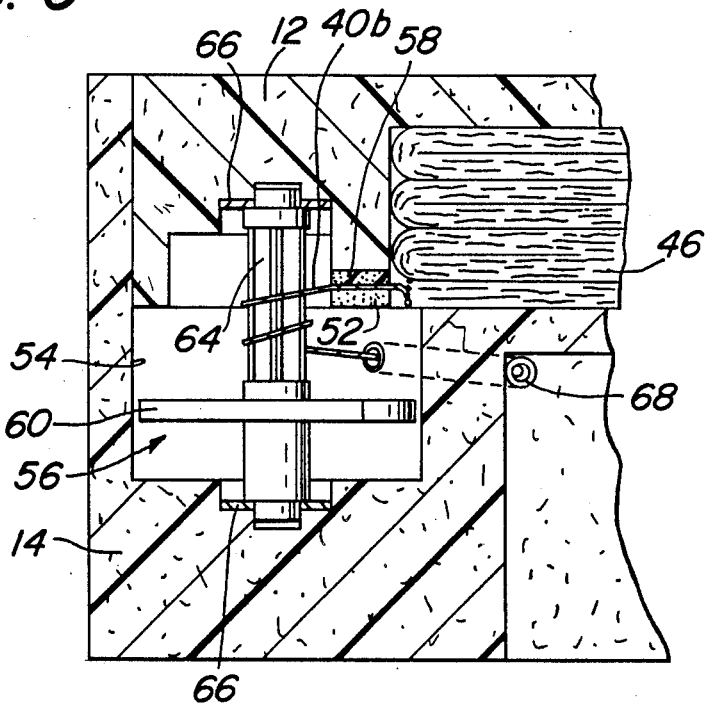
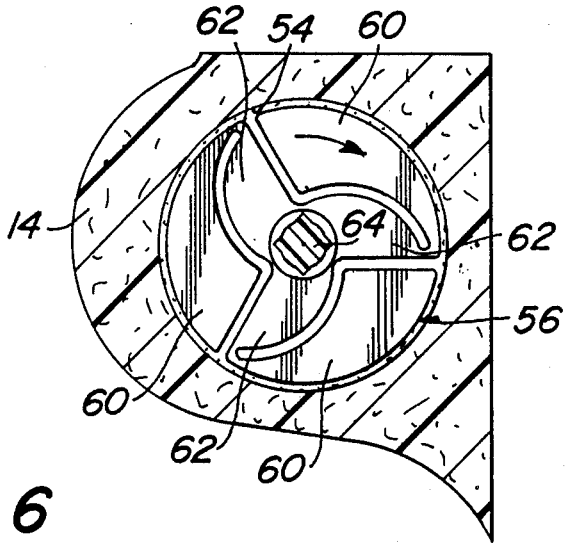
FIG. 6

DEPLOYMENT APPARATUS AND METHOD FOR RADIOSONDES

BACKGROUND OF THE INVENTION

The present invention relates in general to unreeling, and more particularly to a system for controlling the deployment of a radiosonde relative to a balloon from which it is suspended.

Meteorological balloons, usually of high quality natural rubber latex, chloroprene, or Mylar, are used to lift radiosondes to high altitudes for automatic upper air measurements. While ascending, measurements of temperature, humidity and barometric pressure can be transmitted on an RF carrier to a remote station for recording and processing. Radar and radiotheodolites may track the flight to provide data for computing wind speed and direction.

Some radiosondes utilize highly accurate navigation (NAVAID) systems such as the world-wide Loran-C, international Omega, or VLF transmissions for tracking and wind data. Signals transmitted by these systems are at very low frequencies (10–100 kHz) and for best reception require long receiving antennas, for example over 15 feet. Customarily, the antenna includes a metal wire that is stored in the radiosonde for shipment. The wire is withdrawn from the radiosonde and wrapped helically about the cord used to connect the radiosonde to the balloon.

In high winds or onboard ship, two or more operators are frequently required to safely launch the balloon radiosonde without tangling the connecting cord. To minimize the risk of entanglement, the cord is stored on a single reel from which it is paid out as the balloon and radiosonde ascend. The pay out rate is regulated to avoid excessive unwinding. Prior art pay out devices, or so-called dereelers, generally have been complex and costly to manufacture. Their added weight also requires larger balloons with proportionately more gas for adequate lifting. In one system, the cord is paid out from a dereeler, separately housed between the balloon and the radiosonde, at a rate controlled by a ratchet and escapement mechanism. In addition to its complexity and high cost, the inertia of the reel coupled with its intermittent rotation produces sudden and repetitive tension on the cord requiring heavier weight cord and to ensure against breakage. In another deployment system of equal complexity, disclosed in U.S. Pat. No. 1,307,155 to Adolf W. Schramm, an antenna pays out from a reel within an airborne vehicle at a rate controlled by weights rotating with the reel and centrifugally acting on the inner surface of a brake drum.

While reliability is a major factor in the design of radiosondes, costs are a critical factor in the production of balloon radiosondes because they are not normally recovered after ascent. For this reason, simplicity, ease of assembly, and low cost materials of construction are important considerations for the design of an antenna deployment system for expendable radiosondes.

SUMMARY OF THE INVENTION

Accordingly, it is an object of the present invention to provide a deployment system housed within an expendable radiosonde in which a suspension cord and integral antenna connected between a meteorological balloon and the radiosonde are paid out at a controlled rate during ascent.

Another object is to provide a cord and antenna pay out apparatus within a radiosonde housing for suspension from a meteorological balloon in which the components are of simple design, reliable lightweight, inexpensive to manufacture and easy to assemble.

Yet another object is to provide an automatic antenna pay out apparatus which is an integral part of the radiosonde housing, and in which the antenna is stored in a relatively small space within the housing.

A further object is to provide a suspension cord and antenna arrangement which is compactly stored within a radiosonde housing and deployable without entanglement.

Still another object is to provide a deployment system for a long antenna which receives low frequency radio signals from remote navigational aids.

A still further object is to provide a method and apparatus for launching a radiosonde and meteorological balloon system either automatically or with only one operator.

Another object is to provide a method and apparatus for deploying members connected by a length of cord stored in a compact configuration.

Briefly, these and other objects of the invention are accomplished by a radiosonde connected to a meteorological balloon by a flexible multistrand cord, at least one strand of which is electrically conductive to provide a long antenna for a navigation aid receiver in the radiosonde housing. The cord is knit into a tubular body which is folded in a serpentine or other nontangling, readily deployable configuration for storage in a compartment formed within the housing. An end portion of the cord is connected to the balloon via a snubber and centrifugal brake assembly. The cord progressively unravels from the knit body when tensioned. The brake assembly includes a rotor carried by a shaft about which a small portion of the cord is wrapped. The rotor has a plurality of radially movable sectors operable in response to centrifugal force to swing outwardly for frictionally engaging the inner surface of a fixed drum formed in the housing surrounding the rotor. With this structure, the braking assembly governs the rate at which the balloon is deployed relative to the radiosonde as tension applied by the balloon pulls the cord from the knit body and through the snubber. Also, by storing the cord in a knit body, the antenna is paid out without tangling and without complicated and heavy dereeling mechanisms.

BRIEF DESCRIPTION OF THE DRAWINGS

For a better understanding of these and other objects and aspects of the invention, reference may be made to the following detailed description taken in conjunction with the accompanying drawings wherein:

FIG. 1 is an isometric view of a radiosonde according to the invention with a retaining sleeve juxtapositioned for receiving the radiosonde;

FIG. 4 is an enlarged view of the one end of a knit tube of antenna cord stored in the radiosonde;

FIG. 5 is a cross section of an antenna cord pay out apparatus in the radiosonde taken along the line 5—5 of FIG. 1;

FIG. 6 is a section of the pay out apparatus taken along the line 6—6 of FIG. 1; and FIG. 7 is a schematic representation of the radiosonde in various stages of ascent.

DESCRIPTION OF THE PREFERRED EMBODIMENT

Figure 2:
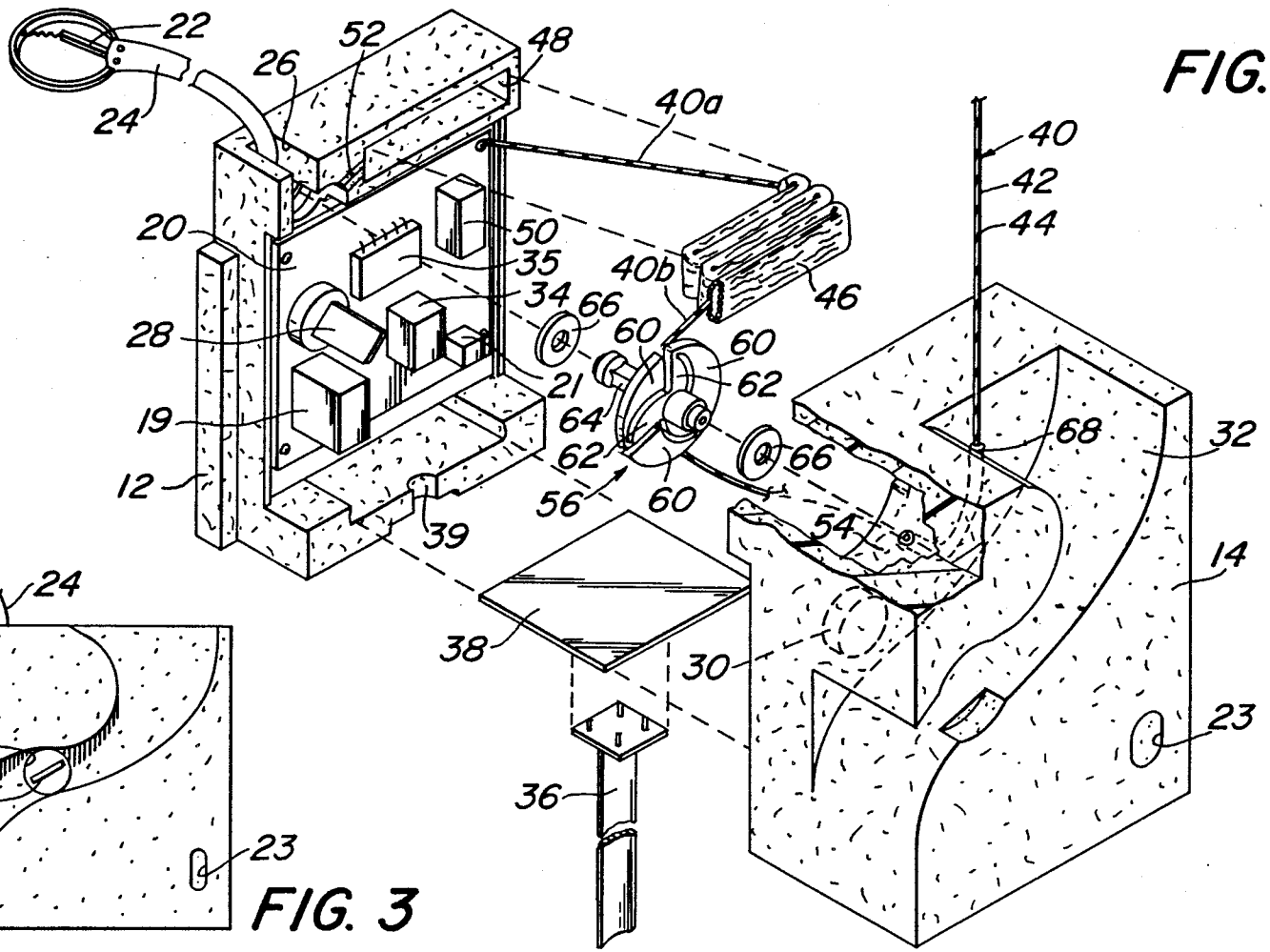
FIG. 2 is an isometric exploded view of the radiosonde of FIG. 1.

Referring now to the drawings wherein like characters designate like or corresponding parts throughout the several views, there is shown in FIG. 1 a radiosonde 10 suitable for being lifted to high altitudes by a meteorological balloon 11 (FIG. 7). As it ascends measurements of upper air data are repetitively radio-transmitted to a remote receiver on a vehicle or ground platform. Signals transmitted by world-wide navigation networks such as Loran-C, Omega, or VLF systems are also retransmitted by radiosonde 10 to the remote receiver for determining position and wind information.

Components of radiosonde 10 are housed within a base 12 and an interlocking cover 14 with their joined surfaces held in place by a retaining sleeve 16 to form a box-like external configuration. Base 12 and cover 14 are each formed of a very light material, such as a rigid polyurethane foam. As best seen in FIG. 2, a printed circuit board 20, on which various electronic components and modules are mounted for data acquisition, processing and transmission, is secured against base 12 by contiguous relief surfaces in cover 14 corresponding to the outline of the projecting components and modules. Power to the electrical components is provided from a battery 19 controlled by an externally actuated on-off switch 21 accessible through an aperture 23 in cover 14.

Figure 3:
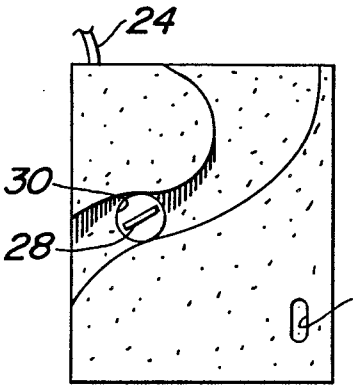
FIG. 3 is a frontal view of the radiosonde.

Air temperature is sensed by a rod thermistor 22 extending by an insulated conductor 24 from board 20 through a recess 26 in the top of base 12. In the preferred embodiment, thermistor 22 is approximately 24 millimeters long and coated with a white, water-repellent material. Humidity is sensed by a carbon hygristor 28 protruding from board 20 through an aperture 30, FIG. 3, in cover 14 and into an open venturi-like duct 32 formed by a recess in the exposed face of cover 14. A protective shield 29 is removed from hygristor 28 through a flap 31 prior to launching. As radiosonde 10 ascends, air enters duct 32 at the top, passes downward over hygristor 28, and exits through one side. Atmospheric pressure is sensed by an aneroid capsule 34 mounted on board 20. Capsule 34 is precisely manufactured and computer-calibrated in a process which minimizes or entirely eliminates the effects due to temperature, hysteresis and drift.

A microprocessor 35 periodically samples the meteorological parameters, for example once per second, and formulates the analog sensor information into a digital data stream for transmission by a transmitter 38 at an ultra-high frequency, such 403 mHz or 1680 mHz, through the down-link antenna 36. Antenna 36 plugs into transmitter 38 nested in the bottom of the radiosonde housing, and extends downward through an aperture 39 at the bottom of base 12.

When NAVAIDS are used, position and wind information is derived at a ground station from retransmission through antenna 36 of signals transmitted by the systems, such as: Loran-C, Omega, or VLF system. The very low frequencies (10–100 kHz) signals of these systems are detected by a suspension antenna 40 formed to be attached to the balloon 11 by any convenient means.

The antenna 40 comprises at least one elongate tension element or cord 42 and at least one electrically conductive element or strand 44 of a length suitable for reception of the transmitted frequencies. The tension element 42 and conductive element 44 are coextensive in length and wrapped helically, or intertwined, so as to be disposed alongside one another and are knit into a tubular body 46. While a variety of different fibers may be used to form the tension element, preferably it is formed of three strands of a continuous filament yarn of man-made high strength lightweight fibers, such as polyester. The conductive element is provided by a single conductive yarn such as Kevlar, nylon or polyester, coated with a metal, such as copper or silver. One such preferred yarn is sold under the trade designation X-TATIC by Saquoit Industries of Scranton, Pennsylvania. While the deniers cf the tension and conductive yarns may vary, depending on strength requirements, it is important for the conductive strand to have a rate of elongation in stretch at least as great as that of the non-conductive yarns in order to prevent breakage of the conductive path when deployed fully. For the disclosed deployment application the conductive element is of 260 denier, and each yarn of the tension element is of 1,000 denier. The elements may be, and preferably are, knit on a circular knitting machine into about a 9/16 inch outside diameter knit tubular body having 12 wales. The knit tubular body is further characterized by a chain stitch throughout so that it can be unraveled.

The antenna 40 of knit body 46 is anchored at one end **40*a* to the circuit board 20 with its conductor 44 electrically connected to a navigational aid receiver 50 of the electronics package 20. Knit tubular body 46 is folded into a serpentine configuration, and stored in a compartment 48 of base 12. The other end 40*b*, connected to balloon 11 and free to unravel from body 46 is routed from chamber 48 through an intermediate tensioner or snubber 52, a cylindrical chamber or drum 54 containing a centrifugal brake assembly 56 and a smooth guide tube 68 communicating between drum 54 and the housing exterior. Snubber 52 comprises a short section of folded elastomeric material, such as rubber or plastic foam, compressed in a recess 58 about antenna 40 to impart a slight drag on antenna 40 as it unravels from knit body 46 and is pulled into drum 54 by the lifting force of balloon 11 on end 40*b***.

Brake assembly 56 comprises three radially movable sectors 60 integrally formed in a planar array at respective outer ends of equally spaced arms 62 carried by a fluted rotor shaft 64 rotatably connected at its ends in bearings 66 seated in a recess of base 12 and cover 14 and coaxial with drum 54. As best shown in FIG. 6, the outer periphery of sectors 60 is concentric with drum 52 with sufficient clearance to permit rotation of rotor 64 at low speeds. At a preselected speed, the centrifugal force acting on the mass of sectors 60 causes them to swing outwardly about their connections with members 62 until they frictionally engage the inner surface of drum 54. Sectors 60, arms 62 and shaft 64 are preferably molded as a unitary body of plastic such as polypropylene with sufficient flexibility and durability in the areas connecting sectors 60 to arms 62 to allow the sectors 60 to repeatedly deflect to cause frictional braking and return to a non-braking position over the entire deployment sequence. The friction force produces a braking action limiting the rotation of shaft 64. Shaft 64 tends to rotate due to the opposite moments of force imparted to it by the lifting force of the meteorological balloon 11 and the lesser drag force of snubber 52. The ribs along the length of fluted shaft 64 provide the diameter needed to yield the proper deployment rate for the antenna 40 as it winds around shaft 64. Approximately 1½ turns of antenna 40 about shaft 64 are preferred after which it exits from cover 14 through a smooth guide tube 68 communicating between drum 54 and the inlet at the top of duct 32.

Operation of the radiosonde deployment apparatus is summarized as follows. Radiosonde 10 is normally stored in a container (not shown) with thermistor 22 and connector 24 folded down along the base 12, and antenna 36 detached and conveniently stored in an accessible location such as in duct 32. After the container and hygristor shield 29 are removed, thermistor 22 extended and antenna 36 plugged into transmitter 38, balloon 11 is attached to antenna 40, and radiosonde 10 electrically energized by manual on-off switch 21. Balloon 11 is partially inflated with enough gas, such as helium or hydrogen, to lift radiosonde 10 at a predetermined rate of ascent to the desired altitude while allowing for balloon expansion.

Upon releasing the balloon-radiosonde assembly for ascent, the tension in antenna 40 imparted by the lifting force of balloon 11 exceeds the resistance force of snubber 52 rotating brake assembly 56 while drawing off stitches of antenna 40 from knit body 46. If the pay out exceeds a preselected rate, the rotation of brake assembly 56 causes sectors 60 to swing outwardly and engage the inner surface of drum 54 and slow down the pay out. The pay out is regulated by the centrifugal force of sectors 60 and the frictional coefficient between the periphery of sectors 60 and drum 54 at a predetermined rate less than the rate of ascent of the balloon. This insures that radiosonde 10 continually rises during antenna pay out as shown in the three stages of deployment in FIG. 7. At ground stage (a) radiosonde 10 is ready for ascent; at stage (b) fifteen meters of antenna 40 has deployed while radiosonde 10 is still rising; and at stage (c) antenna 40 has fully deployed, such as thirty meters. During the ascent, the sensors and navigational aid systems are fully operational for the measurement and transmission to a remote station of temperature, humidity, barometric pressure and retransmission of navigation aid data for processing at a remote receiving station.

Some of the many advantages and novel features of the invention should now be readily apparent. For example, a deployment system is provided for an antenna attached to a meteorological balloon to be launched by one operator or automatic release system and paid out from an expendable radiosonde balloon at a regulated rate less than the ascent of the balloon. An antenna deployment apparatus is provided as an integral part of the radiosonde housing with the antenna stored in a relatively small space therewithin. The deployment system enables the use of a long, lightweight antenna for receiving low frequency radio signals from remote navigational aids such as the Omega, Loran-C and VLF systems. The deployment system is particularly designed to be launched under adverse weather conditions by one person without danger of antenna entanglement. The overall design concept enables use of lightweight components which are of relatively simple design, inexpensive to manufacture and easy to assemble.

If desired, the dereeler need not be incorporated in a radiosonde unit, but may be incorporated in a separate module, in which event the knit tube could be used for any radiosonde application, whether an antenna is required, or not.

It will be understood that various changes in the details, steps and arrangement of parts, which have been herein described and illustrated in order to explain the nature of the invention, may be made by those skilled in the art within the principle and scope of the invention as expressed in the appended claims.

What is claimed is:

1. Deployment apparatus comprising, in combination:

a housing containing a brake drum and a compartment;

brake means having radially movable members carried on a shaft rotatably mounted in said drum, said members frictionally engaging the inner surface of said drum in response to the centrifugal force caused by a predetermined rate of rotation of said shaft;

a cord stored in said compartment having one end fixed thereto, and the other end routed through said drum for attaching to an object, the portion of said cord passing through said drum being wrapped around said shaft; and snubbing means fixed to said housing between said compartment and said drum and frictionally engaging said cord for producing drag thereat;

whereby a controlled rate of rotation is imparted to said shaft when tension in excess of the drag is applied to the other end of said cord.

2. Apparatus according to claim 1 wherein:

said cord within said compartment is stitched into a knit body and unravels when tension is applied to said one end.

3. Apparatus according to claim 2 wherein:

said knit body is folded in said compartment in a configuration that is non-tangling.

4. Apparatus according to claim 1 wherein:

said members comprise a circular array of sectors cantilevered to arms radially extending from said shaft, the periphery of said sectors being in close proximity to the inner surface of said drum.

5. Apparatus according to claim 4 wherein:

said sectors include means for deflecting outwardly in response to the centrifugal force caused by rotation of said shaft.

6. Apparatus according to claim 1 further comprising:

an electrically conducting length of yarn intertwined along the length of said cord to provide an elongate antenna.

7. Apparatus for controlling the deployment of a radiosonde and meteorological balloon assembly comprising, in combination:

a housing formed to enclose the radiosonde, said housing including a brake drum and a compartment;

brake means having radially movable members carried on a shaft rotatably mounted in said drum, said members frictionally engaging the inner surface of said drum in response to the centrifugal force caused by a predetermined rate of rotation of said shaft;

elongate suspension means stored in said compartment having one end fixed thereto, and the other end routed through said drum for attaching to the balloon, the portion of said suspension means passing through said drum being wrapped around said shaft; and snubbing means fixed to said housing between said compartment and said drum and frictionally engaging said suspension means for producing drag thereat;

whereby rotation is imparted to said shaft when tension in excess of the drag is applied to the other end of said suspension means.

8. Apparatus according to claim 7 wherein:

said suspension means within said compartment is knit into a knit body and unravels when tension is applied to said one end.

9. Apparatus according to claim 8 wherein:

said knit body is folded in said compartment in a nontangling serpentine configuration.

10. Apparatus according to claim 7 wherein:

said suspension means includes a cord interwined with an antenna and electrically connected to the radiosonde.

11. Apparatus according to claim 7 wherein:

said radial members include a circular array of sectors cantilevered to arms radially extending from said shaft, the periphery of said sectors being in close proximity to the inner surface of said drum.

12. Apparatus according to claim 11 wherein: the cantilevered connections of said sectors deflect outwardly in response to the centrifugal force imparted by rotation of said shaft.

13. A method for controlling the pay out of a length of cord from a housing, comprising the steps of:

storing the cord in a separate compartment in the housing with one end of the cord extending from the compartment;

routing the one end of the cord around the shaft of a radially movable member rotatably mounted in the housing;

frictionally engaging the member and the housing in response to a centrifugal force at a predetermined rate of rotation of the member until the cord is fully extended; and applying tension to the one end of the cord for imparting rotation to the member as the cord pays out from the compartment.

14. A method according to claim 13 further comprising the step of:

applying a resisting force to the cord as it pays out of the compartment.

15. A method according to claim 13 further comprising the step of:

knitting the cord into a knit body; and unraveling the knit body as the cord pays out.

16. A method according to claim 13 further comprising the step of:

intertwining an electrical conductor along the length of the cord before knitting the body.

17. A method for deploying a first member a selected distance from a second member in relatively close proximity thereto, comprising the steps of:

knitting a cord of a length corresponding to the selected distance into a knit body;

securing the knit body in one of said members with first and second ends of the cord respectively fixed to the first and second members; and applying tension to one cord end for unraveling the knit body and causing the members to progressively separate until the cord is fully extended; and controlling the rate of unraveling of the knit body.

18. A method according to claim 17 wherein:

said controlling step includes causing the cord to pass around a centrifugal brake rotatably mounted in said one member for limiting the unraveling rate.

19. A method according to claim 17 further comprising the step of:

intertwining at least one electrically conductive strand in the cord before knitting into the knit body.

20. An antenna assembly particularly suited for stowage in a compact configuration and deployment into an elongate configuration, comprising:

an elongate, flexible, electrically conductive filament and at least one elongate, flexible filament disposed alongside said conductive filament, said filaments being knit into a body for stowage and being adapted to being unraveled from said body for deployment when tension is applied to said filaments.

21. A method of providing an antenna assembly particularly suited for stowage in a compact configuration and deployment into an elongate configuration, comprising the steps of:

knitting into a body a strand comprising at least one elongate flexible tension element and a flexible electrically-conductive element, stowing the knit body, and unraveling the knit body to deploy the antenna.

22. An assembly particularly suited for stowage in a compact configuration and deployment into an elongate configuration for connecting separable elements, comprising:

an elongate, flexible, filament, chainstitch knit into a body for stowage and adapted for being unraveled from said body for deployment when tension is applied between said body and an end of the filament.

23. Deployment apparatus comprising, in combination:

a housing having an inner surface;

a shaft rotatably mounted in said housing;

a cord stored in said housing having one end fixed thereto and a portion of the other end wrapped around said shaft;

a snubber fixed in said housing frictionally engaging said cord between said portion and said one end for producing a drag force on said cord;

a brake carried on said shaft for rotation therewith, said brake frictionally engaging the inner surface of said housing to produce a brake force in response to centrifugal force caused by rotation of said shaft;

whereby tension applied to the other end of said cord in excess of the drag force dispenses said cord from said housing at a controlled rate until fully extended.

* * * * *

UNITED STATES PATENT AND TRADEMARK OFFICE

CERTIFICATE OF CORRECTION

PATENT NO. : 4,956,646

DATED : September 11, 1990

INVENTOR(S) : Edward J. Miller et al

It is certified that error appears in the above-identified patent and that said Letters Patent is hereby corrected as shown below:

Column 4, line 51, "52" should read -- 54 --.

Column 7, lines 22-23, "the cantilevered connections of" should be deleted.

Signed and Sealed this

Seventeenth Day of December, 1991

*Attest:*

HARRY F. MANBECK, JR.

*Attesting Officer*

*Commissioner of Patents and Trademarks*